US006312334B1

(12) United States Patent
Yoseloff

(10) Patent No.: US 6,312,334 B1
(45) **Date of Patent: *Nov. 6, 2001**

(54) METHOD OF PLAYING A MULTI-STAGE VIDEO WAGERING GAME

(76) Inventor: Mark L. Yoseloff, 1900 Grey Eagle St., Henderson, NV (US) 89014

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/157,651

(22) Filed: Sep. 21, 1998

Related U.S. Application Data

(63) Continuation-in-part of application No. 08/820,438, filed on Mar. 12, 1997.

(51) Int. Cl.[7] ..... A63F 9/22

(52) U.S. Cl. ..... 463/25; 463/20; 273/133.1; 273/143 R

(58) Field of Search ..... 463/25, 20–24, 463/16–19, 12–13, 26, 30–32; 273/143 R, 138.1, 138.2, 269

(56) References Cited

U.S. PATENT DOCUMENTS

| | | | | |
|---|---|---|---|---|
| 4,861,041 | | 8/1989 | Jones et al. | 273/292 |
| 5,019,973 | | 5/1991 | Wilcox et al. | 364/412 |
| 5,033,744 | | 7/1991 | Bridgeman et al. | 273/85 |
| 5,098,107 | | 3/1992 | Boylan et al. | 273/292 |
| 5,288,077 | | 2/1994 | Jones | 273/292 |
| 5,288,081 | | 2/1994 | Breeding | 273/292 |
| 5,332,219 | | 7/1994 | Marnell, III et al. | 273/138 |
| 5,364,105 | | 11/1994 | Jones | 273/292 |
| 5,377,973 | | 1/1995 | Jones et al. | 273/85 CP |
| 5,393,057 | * | 2/1995 | Marnell, II | 273/269 |
| 5,393,061 | * | 2/1995 | Manship et al. | 273/143 R |
| 5,431,407 | | 7/1995 | Hofberg et al. | 273/292 |
| 5,452,899 | | 9/1995 | Skratulia et al. | 273/292 |
| 5,494,287 | | 2/1996 | Manz | 273/143 |
| 5,511,781 | | 4/1996 | Wood et al. | 273/85 |
| 5,529,309 | | 6/1996 | Bartlett | 273/292 |
| 5,531,440 | | 7/1996 | Dabrowski et al. | 463/12 |
| 5,531,441 | * | 7/1996 | Dabrowski et al. | 463/12 |
| 5,542,669 | * | 8/1996 | Charron et al. | 463/13 |
| 5,577,731 | | 11/1996 | Jones | 273/292 |
| 5,584,485 | | 12/1996 | Jones et al. | 273/292 |
| 5,607,162 | | 3/1997 | Boylan et al. | 273/292 |
| 5,626,341 | | 5/1997 | Jones et al. | 273/292 |
| 5,660,391 | | 8/1997 | Klasee | 273/292 |
| 5,660,393 | | 8/1997 | Dreger | 273/292 |
| 5,664,781 | | 9/1997 | Feola | 273/292 |
| 5,794,964 | | 8/1998 | Jones et al. | 273/309 |
| 5,795,225 | | 8/1998 | Jones et al. | 463/13 |
| 5,823,874 | | 10/1998 | Adams | 463/17 |
| 5,848,932 | | 12/1998 | Adams | 463/20 |

* cited by examiner

*Primary Examiner*—Valencia Martin-Wallace
*Assistant Examiner*—Sheila Clayton
(74) *Attorney, Agent, or Firm*—Mark A. Litman & Assoc. P.A.

(57) ABSTRACT

A method of playing a video wagering game is disclosed. The method includes at least a first and second segment, the method comprising the steps of:

placing a wager to participate in a video wagering game;

playing the first segment of the video wagering game;

continuing play of the first segment until at least one predetermined condition has been met;

assigning a payout based on at least one predetermined winning outcome of the first segment;

playing the second segment of the video wagering game when the at least one predetermined condition has been met;

wherein at least a portion of said payout of the first segment is used as a wager in a second segment video wagering game in which a visually different screen format is used in play of a different game in the play of the second segment; and after play of the second segment video wagering game, a second segment payout is assigned based on at least a predetermined outcome of play of the second segment video wagering game.

42 Claims, 7 Drawing Sheets

METHOD OF PLAYING A MULTI-STAGE VIDEO WAGERING GAME

RELATED APPLICATIONS

This application is a continuation-in-part application claiming priority under 35 U.S.C. 120 from U.S. patent application Ser. No. 08/820,438, filed on Mar. 12, 1997 titled "Second Screen Multiplier."

BACKGROUND OF THE INVENTION

1. Field of the Invention

The present invention relates to methods of playing video wagering games. In particular, it relates to a novel method of playing a video wagering game with more than one stage in which the screen format changes significantly between stages and winnings or awards from a first stage may be or must be carried over to at least a second stage.

2. Background of the Art

Video wagering games are popular gaming devices in casinos and other gaming establishments. A number of factors have contributed to the popularity of video wagering games. Gaming establishments have expanded the variety of games offered on video platforms beyond what was once limited to video poker, video keno and video reel slot machines. Many casino table games such as blackjack, draw poker, stud poker, Let It Ride® poker and Caribbean Stud Poker® are available on video. These games can be learned on video machines before advancing to the more intimidating live table game environment. With video wagering, novice players can enjoy playing a wide variety of casino games without having to play at a table with other more experienced players who may create an intimidating environment for the novice. Players of video games need not worry about playing too slowly to suit the dealer or other players or about feeling embarrassed by making a particular strategic decision.

Video wagering games often are capable of paying a progressive jackpot if the player achieves a predetermined winning outcome, which offers the anticipation or hope for a very large award. For the above reasons, the video wagering format is growing at a pace which exceeds the growth of play of live casino table games and other types of live wagering.

One of the more commonly known video wagering games is poker which is available in numerous variations. Other examples include video reel slot machines, and video keno. Video reel slot machines may simulate the play of a mechanical slot machine such as a three reel slot, for example. Because the "reels" in a video gaming apparatus are not limited by the geometry of a conventional slot reel, the game can provide a larger number of pay lines or of winning combinations than can a conventional mechanical slot machine.

Numerous versions of video poker are available, including numerous versions of draw poker, stud poker, and more recently, Let It Ride® poker and Caribbean Stud® poker games. Some video platforms are provided with the capability of the player being able to select from among a number of video wagering games. For example, some gaming establishments provide a number of poker game variations on one multi-game video platform. The games are played independently, one-at-a-time, with no inter-relationship between games.

Some video games which are adapted for play on a home computer have a "second screen" feature. That is, if the player wins a certain number of games, or achieves a predetermined skill level in a game, a second screen will appear which either permits the player to play the same game at a higher skill level or allows the player to engage in a special feature of that game (e.g., collect additional game pieces or 'lives' in Mario Brothers®). In the case of video wagering, there are a few video wagering games which provide an opportunity to first play an underlying or principal video wagering game (e.g., draw poker) and then to play a different wagering game, although on the same video screen format as the poker game (e.g., as with "double down" games described herein). For example, some video poker games offer a double-or-nothing feature. If a player has a winning hand in the first segment of the game, the player can optionally risk the amount won by trying to determine whether a given card will be higher or lower than 8. Alternatively the player may have to choose one of four cards in an attempt to get a card higher than one already shown. If the player wins, his original bet is doubled. He may continue to "double up" until he reaches some predetermined limit, or loses. However, if he loses, he loses the winnings from the first game. This "double up" game is played on substantially the identically formatted screen (showing five playing cards, but with the possible addition to that screen of alphanumerics, as later described) as is the underlying poker game. The principal game, the poker game, is played to obtain an award, and only that award allows winnings from that single game to be "doubled up."

There also exist video wagering games that have a video slot segment and at least one additional video wagering segment. Additionally, there are known second, that is alternative screen games in which the winnings from the second screen game are unrelated to and independent of the winnings in the first screen game.

Although some "second screen" games are known in the video game art, there has not been, to the inventor's knowledge, a multiple game segment video wagering game where the outcome of the second segment can directly enhance the payout of at least a portion of the first segment, and particularly, there is not known to the inventor any video gaming apparatus which provides a first wagering game with a first screen format, and then offers a second wagering game with a second screen format which is substantially visually different from said first screen format and in which second wagering game a portion or all of the award from the first wagering game may be wagered on the second wagering game. For example, in the practice of the present invention a first wagering game could be poker (with for example a display of five cards) and a second wagering game could be Dominoes, Twenty-One, Mah Jong, or another game which does not even include the display of playing cards.

Applicant's commonly assigned coponding U.S. patent application Ser. No. 08/820,438, filed on Mar. 12, 1997 titled "Second Screen Multiplier" describes a second screen video game in which winnings or awards from the play of a first game on a first format screen may be increased or multiplied by play of a second game on a second screen with a different visual format than the first screen.

SUMMARY OF THE INVENTION

The present invention is a method of playing a video wagering game in which there are two distinct video components to either a) at least two distinct games with different video formats played in sequence or b) a single, multi-event game with at least two different video formats, in which at least a portion of the awards or winnings from a first game or event may be or must be carried forward into the second game or the second event. The game includes at least a first and second wagering segment. For purposes of this disclosure, a "segment" is a video wagering game which is capable of being played as a stand alone game (e.g., with a wager and possible outcomes which include the loss of all or a part of a wager, return of an amount equal to the wager, or an award of an amount greater than the initial wager). In the practice of the present invention, at least two of these segments are associated in an order (which order may be consistent or variable over continued play of the game, that is, given segments A, B, C and D, the segments may be played in any order in consecutive games, such as A, B, C and D; B, C, D and A, C, B, A and D; D, A, C and B, etc.). For example, either the player or the video gaming apparatus may select an order of games of poker, dominoes and blackjack; blackjack, dominoes and poker; or dominoes, poker and blackjack.

The method comprises the steps of placing a wager to participate in a video wagering game, playing a first segment of the video wagering game, and continuing to play the first segment of the video wagering game until at least one predetermined condition has been met and for which predetermined condition an award is made to the player. Preferably, there may be more than one predetermined condition which enables advance from the first segment of the video wagering game. The predetermined outcomes may include, for example, achieving a predetermined number of winning outcomes or achieving one of a specific or general group of winning outcomes. The term "predetermined" in the practice of the present invention does not, as previously understood in the art, limit the outcome to earlier identified item specific outcomes. That is, in the prior art, the term "predetermined outcome" would earlier identify hand distributions that would mean, in poker for example, a particular type of playing hand such as a straight, flush, full house, four of a kind, straight flush, etc. In the present invention such an item specific predetermined outcome may be included in the winning outcome, but the outcome may be item non-specific before the event, such as where, after play of an underlying draw poker game, a randomly generated hand or randomly generated number of cards which does not define a hand (e.g., four cards) may be compared for a match with the final hand in the underlying poker game or with a second randomly generated hand, with each of the later generated hands being dealt from independent fifty-two card decks (for example). This type of match card game is disclosed for the first time in copending U.S. patent application Ser. No. 157,971 titled "Match Symbol Side Bet Game", filed on the same day as this application.

One condition that may be imposed, and would usually be imposed, for playing the second segment is to have a winning outcome and an associated payout assigned for the first segment at the time or before the time when the second segment is played. In on example of the invention, once the predetermined condition or conditions have been met, the player must play the second segment of the wagering game using at least a portion of the payout as a wager in the second segment. The second segment may even constitute a separate game which requires a separate wager. This is substantively different from such games a Double-Down after a video game of draw poker where the player has an absolute right of election to play the Double-Down game, either none of the winnings or all of the winnings are usually required, and the screen format remains the same. The second segment in the present invention may even constitute a game which allows the second wager to be completely lost, places only a portion of the wager at risk, or guarantees at least a return of the wager on the second segment, with a possibility of an increased award (by addition or multiplication of the award achieved on the play of the first segment wager game). In another example of the present invention, a player can optionally choose to participate in the second segment of the game, and is required to put all or part of an award earned in the first segment at risk. Every outcome of the second segment may have a factor associated with it which enhances the payout of the first segment, e.g., by multiplying the original payout by the factor. According to one method of practice of the present invention, the minimum factor in the second segment could be one. The player in that instance is therefore guaranteed a payout at least as great as the original payout, and hence does not risk the payout awarded in the first segment by playing the second segment of the game. Additionally, one or several predetermined outcomes of the second segment may be assigned fixed or progressive jackpots, yielding even larger winnings for the player.

DETAILED DESCRIPTION OF THE INVENTION

The present invention is a unique method for scoring and participating in a video wagering game. The preferred method can be used to play and/or score virtually any video wagering game having at least two distinct playing segments. Although the method of the present invention is preferably used to score video poker games, the method can be applied to virtually any segmented game where winning outcomes can be determined in advance, and at least one predetermined condition in the first segment can be identified in order to qualify the player to advance to the second segment of the game.

An aspect of the present invention contemplates a mandatory second wager requirement to participate in the second segment of the game, the second wager being required to come from at least a portion of an award from a preceding segment and payout from a preceding segment (or in the case of the play of a third segment, from the earlier played first and second segment). When the play in the second segment is mandatory, the award from the first segment may be used so that it is not at risk. For example, a multiplier may be used in the second screen format which is always 1.0 or larger.

Figure 1:
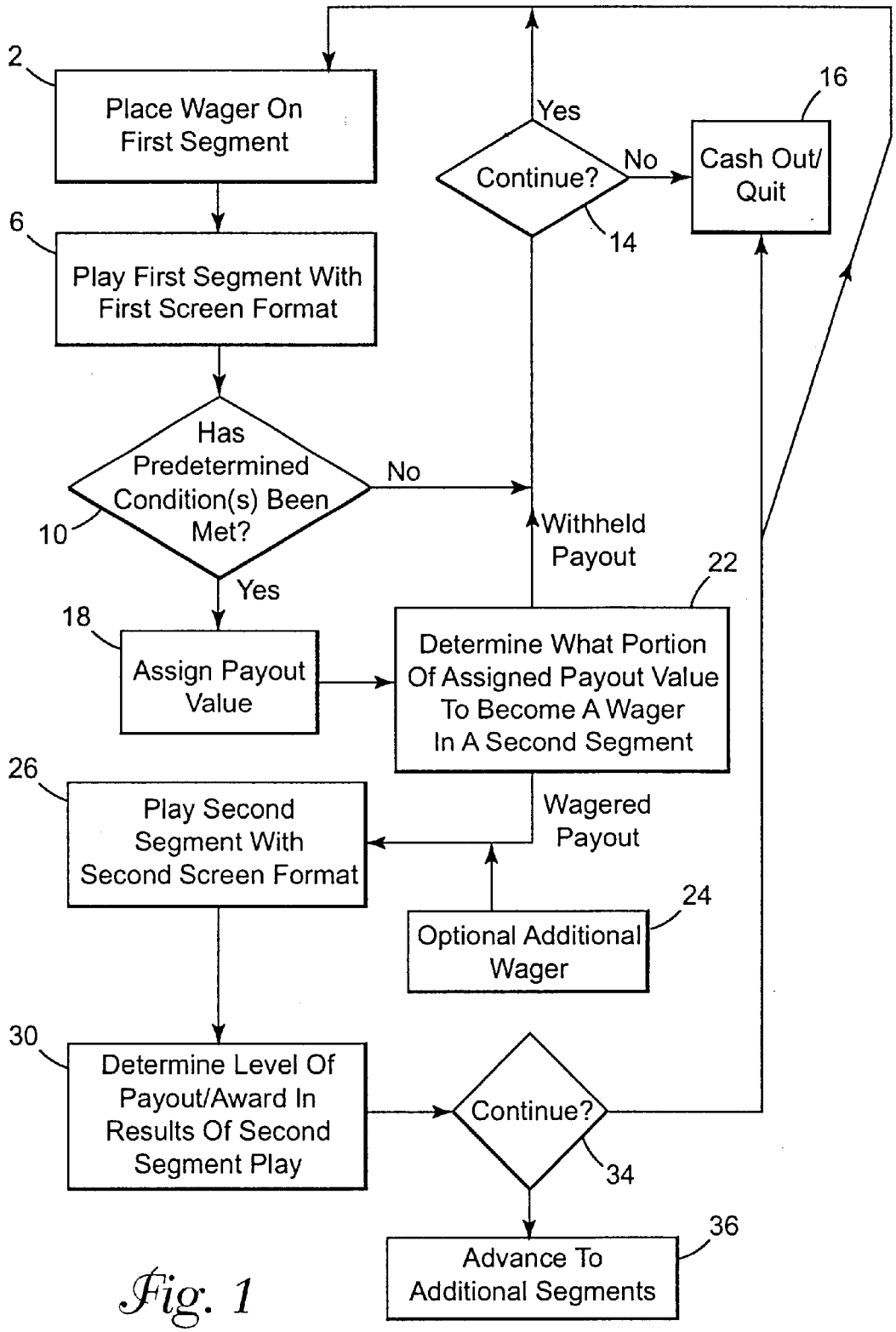
FIG. 1 is a flow diagram of a method of the present invention.

A flow diagram of the method of the present invention is shown in FIG. 1. A player places a wager 2 to participate in a first segment of a video wagering game. The player first plays the first segment 6 of the video wagering game. If at least one predetermined condition 10 has been met, a payout value 18 is assigned to the play of the first segment of the game 6. Preferably, the player must repeat the wagering 2 and playing 6 steps a number of times before the predetermined set of conditions 10 has been met. The payout is not automatically deposited or dumped into a credit account, as at least a portion of the immediate award must be carried forward into the next segment as a mandatory wager. Although it is preferred that the player continue to place wagers with each round of play of the first segment, the present invention contemplates placing only one wager 2 in the first segment and then carrying forth at least a portion of any award from the first segment into play of a second segment. Between play of each number of the first segment 6, the player has the option to continue 14, or cash out and quit 14 and 16. Of course, if the player does not have any credits remaining, the player simply quits 16 playing the first segment 6.

According to one game method, when the player has achieved a predetermined number (including one outcome) of winning outcomes, the predetermined set of conditions has been met 10. When the set of predetermined conditions has been met 10, a payout value is assigned 18 to at least one predetermined winning outcome from the play of the first segment 6. Preferably, the last predetermined winning outcome is the basis for assigning a payout value 18, although a cumulative award basis or partial accumulated award basis (e.g., all of the awards leading to the predetermined winning outcome, the last two hands, the last five hands, the largest award in the last selected number of hands, etc.) may be used.

Next, the player must exercise an option 22 of participating in the next segment of the game. The player determined the amount or portion of the assigned payout value 18 which is to be wagered in the play of a second segment 26 or a portion of which is to be credited to the player for a cash out 16. In one embodiment of the present invention, the player may elect to place the entire award as a wager in the second segment, place a portion of the award as a wager in the second segment and accept the remaining portion as a credit, but may not receive the entire award as a credit for play in the first segment 2 and 6. This last restriction may be voided or prevented where the first award does not reach a minimum threshold multiple of the initial wager. For example, the player may retrieve a one-to-one award, but must wager a portion of all awards with payouts of at least three-to-one, at least five-to-one, at least eight-to-one and the like. In that event, the player may retrieve or wager the award or part of the award in the second segment. There may or may not be additional wager 24 required to participate in the play of the second segment, in addition to advancing a portion of the award from the play of the first segment. The optionally provided additional wager 24 may or may not influence the payout potential of the second segment, as in initiating a fixed award jackpot or progressive jackpot entry. The present invention contemplates providing an optional or required second wager to participate in the second segment. It is to be understood that the second wagering event might necessitate modifying the preferred pay tables of the present invention. That is, because the second segment influences the total amount of award which may be available from a single unit of wager, the pay tables in the first segment may significantly vary from standard pay tables of a similar game, offering either higher awards or lower awards for a given outcome.

Figure 6:
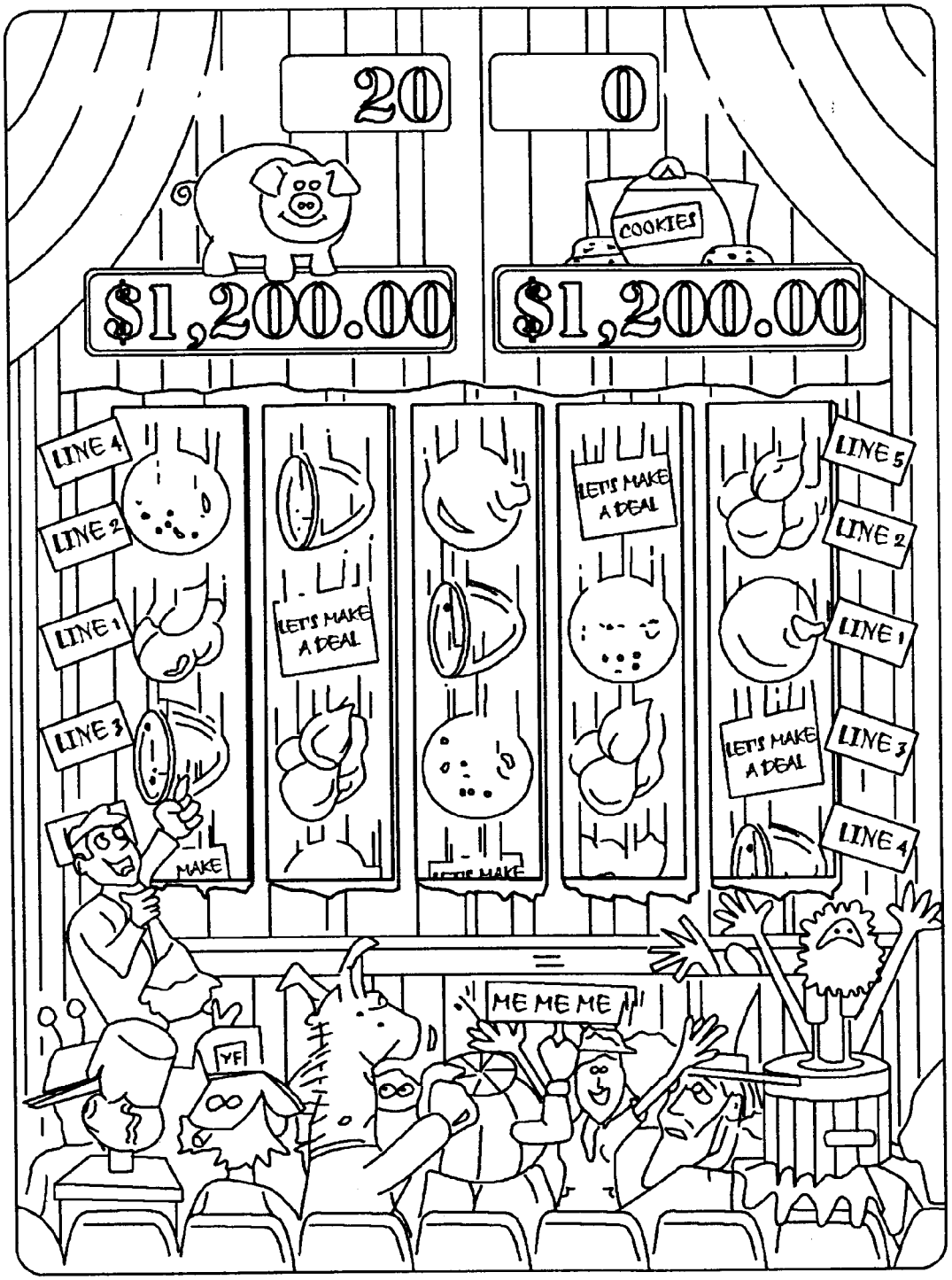
FIG. 6 shows an example of a first screen layout for play of a first segment in the appearance of a slot machine with unique symbols.

At the conclusion of play of the second segment 26 which has a visually different screen format than play of the first segment 6, an award or factor is identified and the level of payout, bonus or award is determined from the second segment of play 30. The terms payout and award or bonus have related meanings. The payout is usually intended to mean the number of wager credits or coins to be returned to the player from the results of play. An award may include the payout, but may also include potentially non-monetary elements such as the right to proceed to another segment or the accumulation of credits towards play in a special segment for ajackpot or progressive jackpot. For example, in the play of the first segment, if the payout is only an equal value award, there may be no right to advance to a second segment, while if the payout is at least three times the wager, there may be an award of an opportunity to advance to a second (or further) segment play, carrying at least a portion of the award forward as the wager in the second segment. A bonus may be in addition to a payout and award, and may be monetary or non-monetary value towards play or amounts towards a particular payout or jackpot. For example, after play has been enabled in a second or further segment, bonus values may be awarded for particular results in the play, and these bonus values may be carried forth in search of a particularly high payout, factored payout or jackpot. A further example of this type of play would include where, as shown in FIG. 6, three doors are to be chosen for an award, if a player chooses the highest value door, a bonus value may be credited on the apparatus (and, for example shown on the screen). A jackpot may be awarded when a set number, e.g., 3,4, 5, 6, 7, 8, 9, or 10 consecutive plays of the first and second segments results in the highest value door. An option 34 may be provided to the player to convert the bonus values to free plays of the first segment or to advance to a third segment 36 (with the same or visually different screen format). In a second example of the invention, the player may choose to play a second segment of the game in a different screen format. Preferably, entire awards from the first segment are placed at risk when there is an option to engage play in the second segment. Alternatively, only a portion of the award may be placed at risk. Thus, all or only a portion of the award from the first screen may be wagered in the play of the second segment on a different screen format.

According to one aspect of the present invention, payouts from the first segment may be enhanced by multiplying the assigned payout value by a multiplication factor, hereinafter referred to simply as a "factor" or by allowing the player to wager part or all of the payouts from the first segment in a separate game which may offer the opportunity to multiply or otherwise increase the payouts in a different formatted screen and different game. Where there are significantly large awards possible in the play of second or other subsequebt segments, there should be a risk to the initial award involved in the play of the second segment. Preferably with more moderate award effects (e.g., increasing the award by fixed amounts such as five tokens or credits, or by multiples of less than five), the factor is always an integer equal to or greater than one, or to add a little tension to play of the game, at least one potential outcome is for the factor to be a positive value above zero but below one. In other words, the player is not putting the entire payout of the first segment at risk by participating in play of the second segment. This unique feature adds fun and enjoyment to the game. Since there may even be no risk in participating in the second segment, there is really no reason why the player would choose not to participate. In fact, in the example described below, participation in the second segment is required.

The method of the present invention is particularly suited for all existing video games including elements of poker games and non-poker games. The present invention includes a contemplated multi-level game with a first segment that is a variation of video poker or is a non-poker game. The scoring method of the present invention is suitable for scoring video wagering games with a first segment which is Stud Poker, Draw Poker, Caribbean Stud® Poker, Let It Ride® Poker, Jokers Wild Poker, Deuces Wild Poker and other poker variations. The method could be used in connection with other card games such as blackjack, for example. The method could also be adapted to play with other video wagering games which are played on a visually different format of the screen such as bingo, keno, dominoes, Mah Jong, hangman, solitaire, tick tack toe and video slot reel games, for example. Similarly, the second segment of the game can consist of all of the above, in addition to other games such as high/low, for example.

The method of the present invention has particular benefits with respect to at least one of the segments being a non-traditional casino game. For example, a first game segment may be a video enactment or video screen representing Let's Make a Deal® (e.g., with a video display of a game show host/hostess, part of an audience, part of a stage, etc.), with the second game segment showing an entirely different screen view of the three doors, behind which one makes a selection of prizes, as in the live television play of the game show Let's Make aDeal®. The selection from amongst the three doors may include, one door causing loss of the entire wager, a second door causing a more neutral event (e.g., a push, loss of a percentage of the wager, gain of a small percentage of the wager, etc.), and a third door causing a doubling or otherwise substantial increase in the wager award. Additionally, special bonus points may be accumulated by guessing the bonus door (with points either always accumulating for a subsequent wager irrespective of door selection outcomes, points accumulating only until the loss door is encountered, or points accumulating only for consecutive winning door selections). These bonus points may accumulate towards the player using the points to multiply the bonus awards on a single wager in the underlying game or the first game segment, or (particularly where points are only accumulated with consecutive winning door selections) points may be accumulated towards a jackpot or even a progressive jackpot (e.g., a jackpot is paid out when at least five consecutive winning doors are selected, and a progressive jackpot is awarded when at least ten consecutive winning doors are selected). The play of segments in sequence which have an art (especially including the entertainment art) recognized relationship is referred to herein as "thematic continuity." This would be inclusive of a first game in the format of a contestant or player involved in a first game (e.g., a version of video slots) to enable advancement to another game, such as the door selection segment seen on the live television play of the game show Let's Make a Deal®. Other thematically continuous plays would include spinning a roulette-type wheel (as in Wheel of Fortune®) which is followed by a separate and distinct guessing game in a visually different format, with different rules; a card game in which a player first competes against a dealer or house hand followed by a game (card or otherwise) in which the player competes to attain predetermined (or after-determined) combinations of symbols (including cards).

In this apsect of the invention, the video game may be described as a method of playing a video wagering game, the game comprising at least a first segment and a second segment, the method comprising the steps of:

placing a wager to participate in a first video wagering game having a first screen format representing a game show (e.g., Let's make a Deal®, The Price Is Right®, Wheel of Fortune®, Jeopardy®, Hollywood Squares®, or any game having the visual appearance of a game show, as with a stage, participants, host/hostess, audience, marquee, etc;

playing the first segment of the video wagering game;

continuing play of the first segment until at least one predetermined condition has been met;

assigning a payout based on at least one predetermined winning outcome of the first segment;

playing the second segment of the video wagering game when the at least one predetermined condition has been met;

wherein at least a portion of said payout of the first segment is directly used as a wager in a second segment video wagering game in which a second screen format is used in the play of the second segment, which second screen format is visually different from the first screen format and also represents a segment of a game show (e.g., where the first segment engages play of a spilining wheel to match numbers or total points closest to a target value when spinning the wheel and the second segment screen format has multiple door selection or matches symbols and/or values, as in an alternative to matching prices with specific products as done on The Price is Right®, and the second screen format is used in the play of a different wagering game than that played in said first segment; and after play of the second segment video wagering game, a second segment payout is assigned based on at least a predetermined outcome of play of the second segment video wagering game.

According to one preferred method of play, the first segment is Let It Ride® poker and the predetermined winning outcome of the first segment is achieving a known winning hand from a plurality of poker hands having conventional poker hand rankings, such as two pairs, for example. In the example which is described below, the minimum ranking poker hand required to meet the predetermined conditions is a pair of 9's. According to the invention, there must be a payout to meet the predetermined conditions.

Wagers are placed according to conventional play of video wagering games. For example, a player may insert coins, bills, tokens or register credits in another manner to participate in the game. Playing the first segment can either take place automatically as the result of placing a wager, for example, or in response to instructions from the player transmitted to a microprocessor via player controls. The term direct usage of the award from an earlier segment requires that any such award not be first accumulated into a general credit fund or bank, but that the award or a portion of the award is chosen by a player to be forwarded as a wager in a second segment.

A preferred method of play of the present invention includes providing a progressive payout in the event a predetermined winning combination on a different visually formatted screen is achieved in the second segment of the game. The term "visually different formatted screen" means more than merely the addition of only alphanumerics to the original screen, as is done is "Double-Down" poker play. In that format, after a winning hand is achieved, alphanumerics (e.g., "Play Double Down?", "Yes," "No," and arrows pointing to the appropriate keys or buttons to engage the Double Down segment) appear on the video screen with the winning hand asking the player if the player wishes to engage play of the double down game. The visual appearance of the screen is the winning poker hand with the addition of alphanumerics. Furthermore, the "Double-Down" game shows the backs of five playing cards which is substantially the same visual appearance as the first segment game showing either five playing cards facing down with a turning of the cards to initiate play, or 'dealing' five cards face up to initiate play. The closest resemblance which a second segment wagering game may have to a first segment wagering game and be within the broadest definition of "visually different formatted screen" is to provide a different number of symbols such as playing cards (in the first appearance of the second segment screen, as with a second segment of Twenty-One following a first segment of draw poker, or a three reel slot game followed by a five reel slot game) between the two segments. For example, if the first segment wagering game is five card stud or five card draw, the second segment wagering game may be Twenty-One, which requires an initial deal of only two cards. By varying the screens with different games in sequence, a greater feel for a live table poker game may be effected, where different games may be called by the different players as they receive the deal. One series of progressive games may include a first hand of draw poker, one hand of blackjack, one hand of five card stud, and one hand of seven card stud, with special awards given if the player can win all of the programmed games in sequence. The progressive jackpot game even may be entered by placing a new bet after passing the first hurdle of winning a first game in the series of games. The term "visually different formatted screen" can also include requirements that not only does the primary visual format of the game differ (e.g., cards versus roulette versus slot wheels versus doors versus Mah Jong tiles versus dominoes, etc.), but may also include a requirement that the screen indicates different operation functions for keys or buttons and/or indicates differences in rules of play of the second segment different game. It is of course contemplated that the visually different screen may display different backgrounds or backdrops than the earlier screen, as well as different game functional elements.

Another way of describing a form of play of the multiple segment game of the present invention is as a method of scoring a video wagering game, the game comprising at least a first and second segment, the method comprising the steps of:

placing a wager to participate in a video wagering game;

playing the first segment of the video wagering game;

continuing play of the first segment until at least one award-achieving condition has been met;

assigning a payout based on the at least one award-achieving condition of the first segment;

optionally or mandatorially playing the second segment of the video wagering game when the at least one predetermined condition has been met;

wherein at least a portion of the payout of the first segment is directly carried into the second segment as a wager in a second segment video wagering game in which a visually different screen format is used in play of a different game in the play of the second segment; and after play of the second segment video wagering game, a second segment payout is assigned based an award winning outcome such as on at least a predetermined outcome of play of the second segment video wagering game.

The method may optionally require that at least a portion or all of the payout based on the at least one award-achieving condition of the first segment may be or must be carried forward as a wager in the second segment. The method may also optionally require that a portion or all (particularly where a low award payout, e.g., only one-to-one) of the payout based on the at least one award-achieving condition of the first segment is retained as a credit or paid out to a player.

Figure 2:
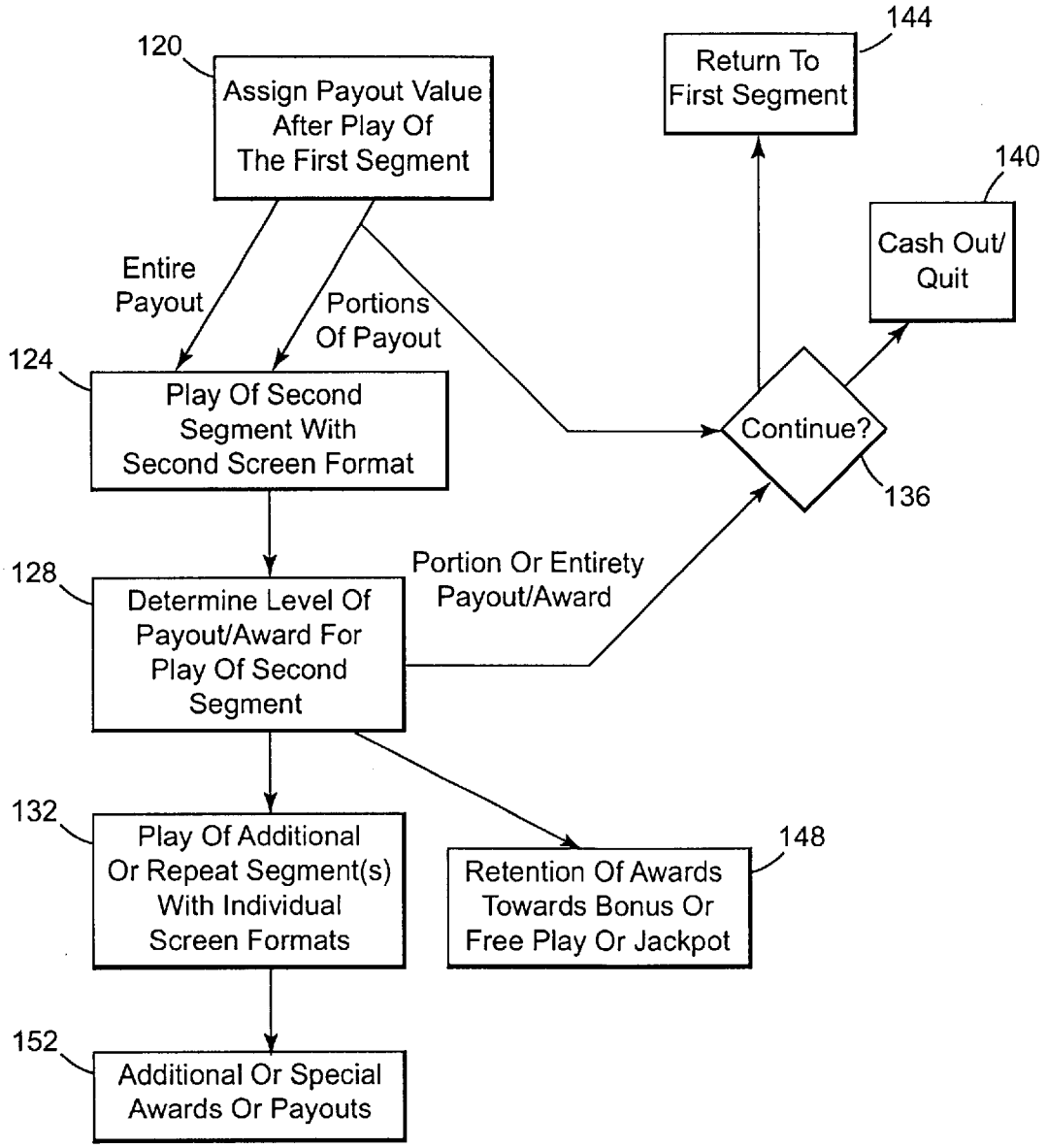
FIG. 2 is a flow diagram illustrating an optional enhanced payout option of a method of the present invention.

FIG. 2 is a flow diagram which shows how a method according to the present invention may be practiced. After an assigned payout value has been made in the play of the first segment 120, the player may elect to wager the entire payout or a portion of the payout in the play of a second segment with a visually different formatted screen 124. Any portion or all of the payout 120 may be the basis of a decision 136 to continue play, cash out or quit 140 or return to the first segment 144. With any further wager in the second segment 124, the play of the second segment will determine the level of payout, award or bonus for the play of the second segment 128. The player may at that time determine what portion of the payout, award or bonus is to be applied among the various options allowed. These options, for example, include but are not limited to cash out or quit 140, return to the first segment 144, play of additional or repeat segments (including the second segment 132, or retention of awards or bonuses towards free play or a jackpot 148. Continued play of additional or repeat segments 132 may result in additional or special payouts, awards or bonuses 152, including a fixed award or a jackpot, such as a progressive jackpot.

Figure 3:
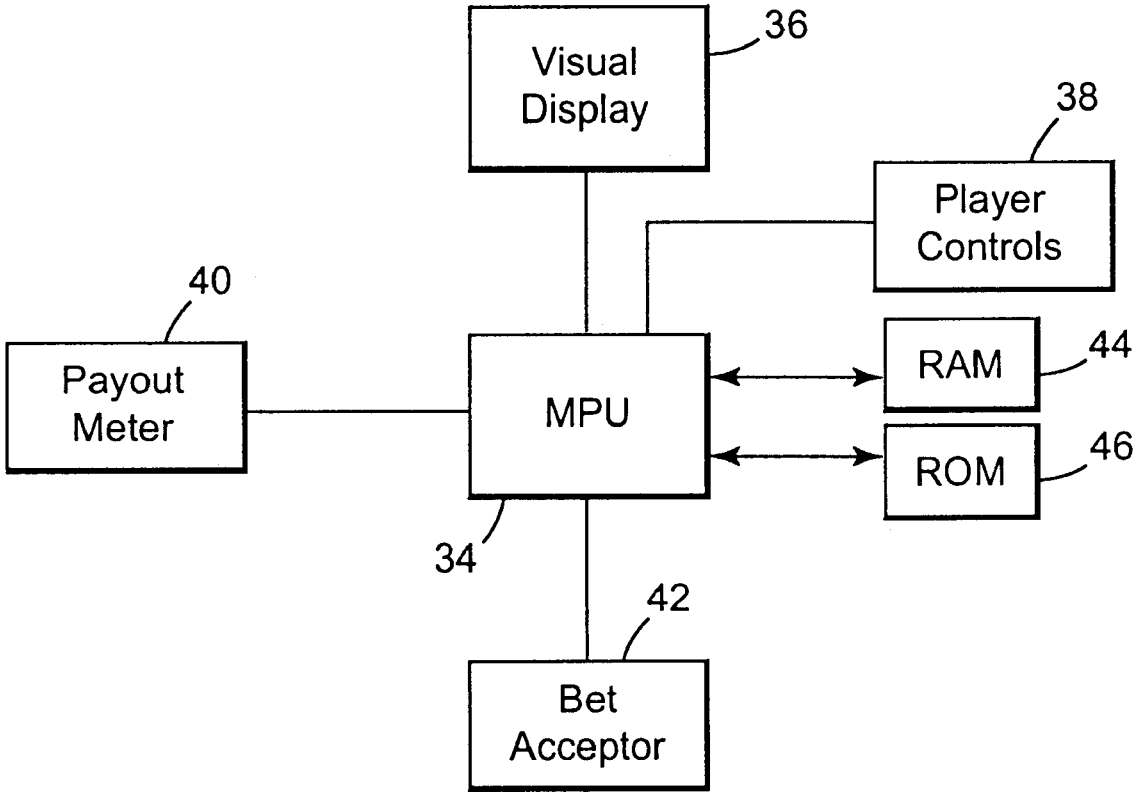
FIG. 3 is a schematic diagram showing a device of the present invention.

A video wagering device of the present invention includes a microprocessor (MPU) 33, as shown in FIG. 3. The MPU can be a conventional home computer or other known microprocessor commonly used in gaming devices. A visual display 35 such as a cathode ray tube, for example is provided to show a visual representation of the video wagering game of the present invention. The visual display 35 and MPU 33 are mounted within a video terminal cabinet 36 (shown in FIG. 4). A plurality of player controls 38 are provided and are preferably mounted in the cabinet 37. The device is equipped with a payout meter 40 and a device for accepting bets 42. The MPU is equipped with memory, such as RAM 44 memory, as well as ROM 46 memory. A program is loaded into the ROM memory 46 which provides visual images which correspond to the first and second game segments, and allow the player to input instructions into the RAM memory 44. Although the device and method of the present invention are described in terms of providing a two segment wagering game, it is to be understood that the game and device of the present invention can be used to provide video wagering games with more than two segments. The payout from the first game can be enhanced by outcomes in each successive game, for example.

The MPU is further programmed to register bets, credit bets, calculate payouts, continually check to see if all of the set of predetermined conditions have been met, determine if the winning outcome qualifies for a progressive payout, receive player instructions, dispense payouts and provide visual displays in response to player instructions. Each of the visual display 35, the payout meter 40, the bet acceptor 42 and the player controls 38 are preferably electronically connected to the MPU 33 by means of a data bus.

Figure 4:
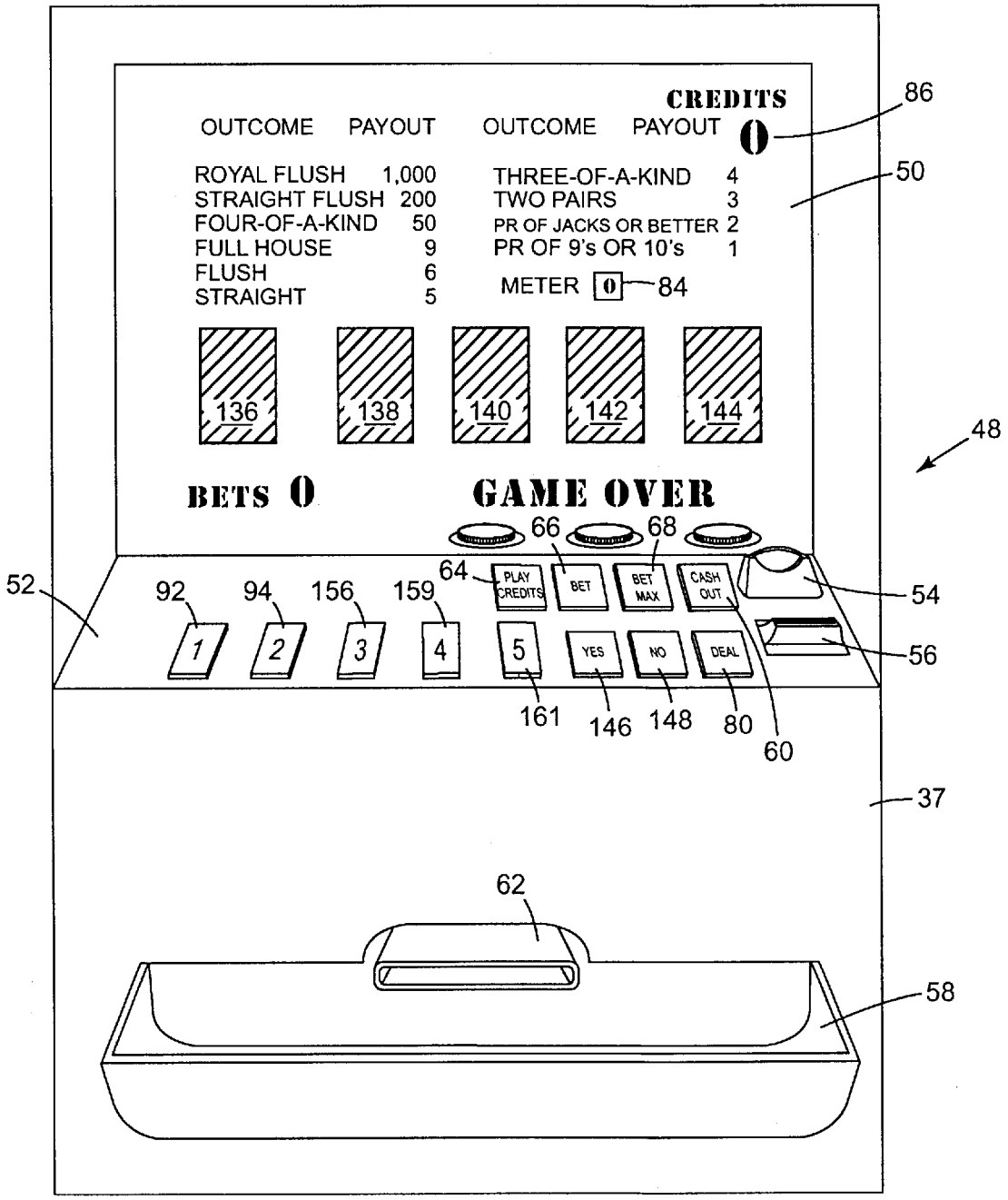
FIG. 4 is a front elevational view of a preferred video wagering machine of the present invention.

As shown in FIG. 4, in a preferred game of the present invention, a video wagering device 48 is provided with a visual display 50, a plurality of player controls 52 mounted into the cabinet 37, a coin acceptor 54, a bill acceptor 56 and a coin collection tray 58. The player controls 52 preferably include a plurality of numbered buttons 92, 94, 156, 159, and 161, "yes" and "no" buttons 146 and 148 for election of any options during play of the segments or for making decisions after play and/or after awards on each segment, "bet" 66, "Max bet" 68 and "play credit" 64 buttons, "cash out" 60 and a "deal" 80 button. If a player chooses to cash out winnings, the cash out button 60 is depressed, and all credited wins are dispensed through chute 62 into tray 58. Other buttons or keys which are not shown may include a proportionating key for dividing awards for retention versus advanced play, conversion of award buttons, conversion of bonus buttons, and the like.

In a preferred method of the present invention, Let It Ride® poker is the first segment of the video wagering game, and ordinary Twenty-One is the second segment. Let It Ride® poker is fully described in U.S. Pat. No. 5,288,081 to Breeding and is hereby incorporated by reference. This patent is commonly owned by the assignee of the present invention.

Figure 5:
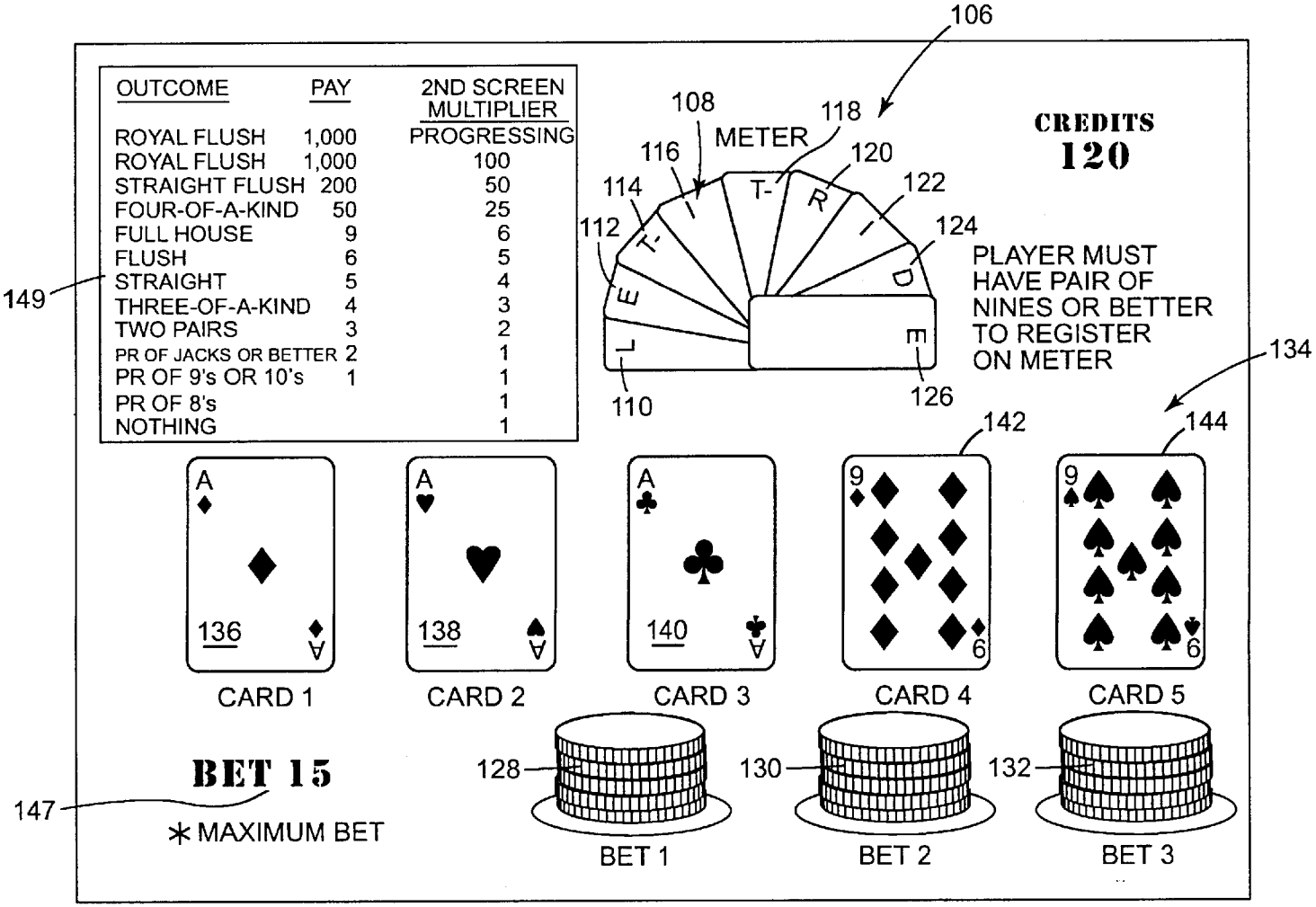
FIG. 5 shows a first screen format for play of a segment which is played as Let It Ride™ poker.

In a preferred screen display 106, as shown in FIG. 5, a fanned shaped meter 108 is provided which represents nine playing cards 110, 112, 114, 116, 118, 120, 122, 124 and 126. Alternatively, a meter which is a numerical counter 84 (shown in FIG. 4) is provided. Any type of electronic, mechanical or electromechanical meter could be used. Preferably, the visual representation of each card 110, 112, 114, 116, 118, 120, 122, 124 and 126 includes a sinole letter on each card, which spells Let It Ride. There are a total of nine cards. When a winning combination of cards is achieved in the first segment of the game, one card in the fan is turned over, and appears as if it were filled in with a solid color (not shown). In this example, the meter 108 increments to nine, at which time the MPU causes the visual display to advance to the next segment, providing that the remaining predetermined conditions have been met.

The play of the underlying game is briefly described as follows. The player places a wager, which preferably is a three equal part bet. A visual display of the three parts of the bet 128, 130 and 132 is incorporated into the preferred screen display 134. A video representation of a five card hand is displayed. The cards are drawn randomly from a single deck of cards. Each card 136, 138, 140, 142 and 144 is dealt face down. After the player places his wager, he/she depresses the deal button 80 (shown in FIG. 4). The first three cards 136, 138 and 140 are turned face up, and the remaining two cards 142 and 144 remain turned down. At this point, the player is given the opportunity to withdraw the first part of the bet, based on his assessment of the likelihood that the hand will be a winning hand. If the player wishes to withdraw the bet, he/she depresses the "no" 148 button (see FIG. 4). In this instance, the player has drawn three aces, which in itself is a winning hand. The therefore would choose to "let it ride," by selecting the "yes" button 146 and continues to maintain that portion of the bet. Once "yes" or "no" is chosen, the fourth card 142 is turned over. The is then given the opportunity to "Let It Ride" by pressing the "yes" button 146, or withdraw a second portion of his bet 130 by depressing the "no" button 148 on the player control panel. Since he has already determined that the hand is a winning hand, he would continue to "let it ride." Again, upon choosing "yes" or "no", the final card 144 is turned over, and the hand is scored. According to the preferred method of play, the payout for a full house is 9 for one. At the beginning of play, and before any bets are placed, the screen display 50 preferably shows zero credits 86 (shown in FIG. 4). Just prior to play of the last hand which increments the meter to the ninth position, the player has 120 credits. The player placed the maximum bet of fifteen coins which is shown at 147 on screen display 134. The player achieved a full house which is one predetermined arrangement of cards, and according to the preferred pay table, pays 9 for 1. The most preferred predetermined arrangements of cards, corresponding payouts and respective factors are shown in the table below:

| Outcome | Payout | Factors |
|---|---|---|
| Royal Flush (max. bet) | 1000 | progressive |
| Royal Flush | 1000 | 100 |
| Straight Flush | 200 | 50 |
| Four-of-a-kind | 50 | 25 |
| Full House | 9 | 6 |
| Flush | 6 | 5 |
| Straight | 5 | 4 |
| Three-of-a-kind | 4 | 3 |
| Two pairs | 3 | 2 |
| Jacks or better pair | 2 | 1 |
| Pair of 9's or 10's | 1 | 1 |
| Low pair | | 1 |
| Nothing | | 1 |

This pay table 149 is preferably incorporated into the visual display 134 of the first segment. Alternatively, the MPU is programmed to display the type of winning hand, payout and factor for a single winning outcome only when that outcome is achieved. Displaying the factors provides the player with an incentive to continue to fill in the cards 110, 112, 114, 116, 118, 120, 122, 124 and 126 of the meter 108. The meter 108 also creates an incentive to advance to the next screen because it motivates the player to finish what he has started.

According to the preferred method, any winning hand ranking will increment the meter 108, providing that a maximum bet was wagered. A "winning " hand for purposes of this disclosure is one that has a payout, according to conventional poker hand rankings. When the last card 126 on the meter 108 is filled in, the MPU causes the screen display to advance to the next segment of the game.

In one aspect of the game, the next segment which the player may elect to proceed to may be Twenty-One. The player elects all or a portion of the award from the poker game to be used in the play of the next segment of Twenty-One, and elects to retain a portion of the winnings as credit. Upon election to proceed to the next segment, a visually different screen format appears with which the player is to engage in play. The second segment game is then played and the award, if any, determined. This variation in the underlying nature and appearance of the segments adds a new component to the play of video wagering games making them appear more like private table games where the games may vary from hand to hand. In the play of the Let It Ride® poker and the Twenty-One, bonus values may be awarded for blackjacks or winning both ends of a split hand, or winning a double down hand. These bonus values, as earlier indicated, may be used in different ways, collecting towards a special chance at a jackpot, be convertible to free plays, etc.

In another embodiment of the present invention, the payout is further enhanced by paying a progressive jackpot if the maximum bet is placed, and a unique or special distribution of symbols or events occur, such as in Let It Ride® poker where a royal flush (ace, king, queen, jack and ten of the same suit) is achieved or if a certain number of bonus values are applied to the play of that segment. It is contemplated that 100% of a progressive jackpot would be awarded to such a hand. In other embodiments, lower ranking poker hands, such as a straight flush would qualify for 20% of the progressive jackpot, for example.

In order to maximize the appeal of a progressive jackpot feature, it would be desirable to pool a small percentage of the bets placed on a plurality of machines to fund the progressive jackpot. For example, it would be desirable to set aside about two percent of the coin in, and hook up a bank of video wagering games so that the prize pool climbs quickly.

Figure 7:
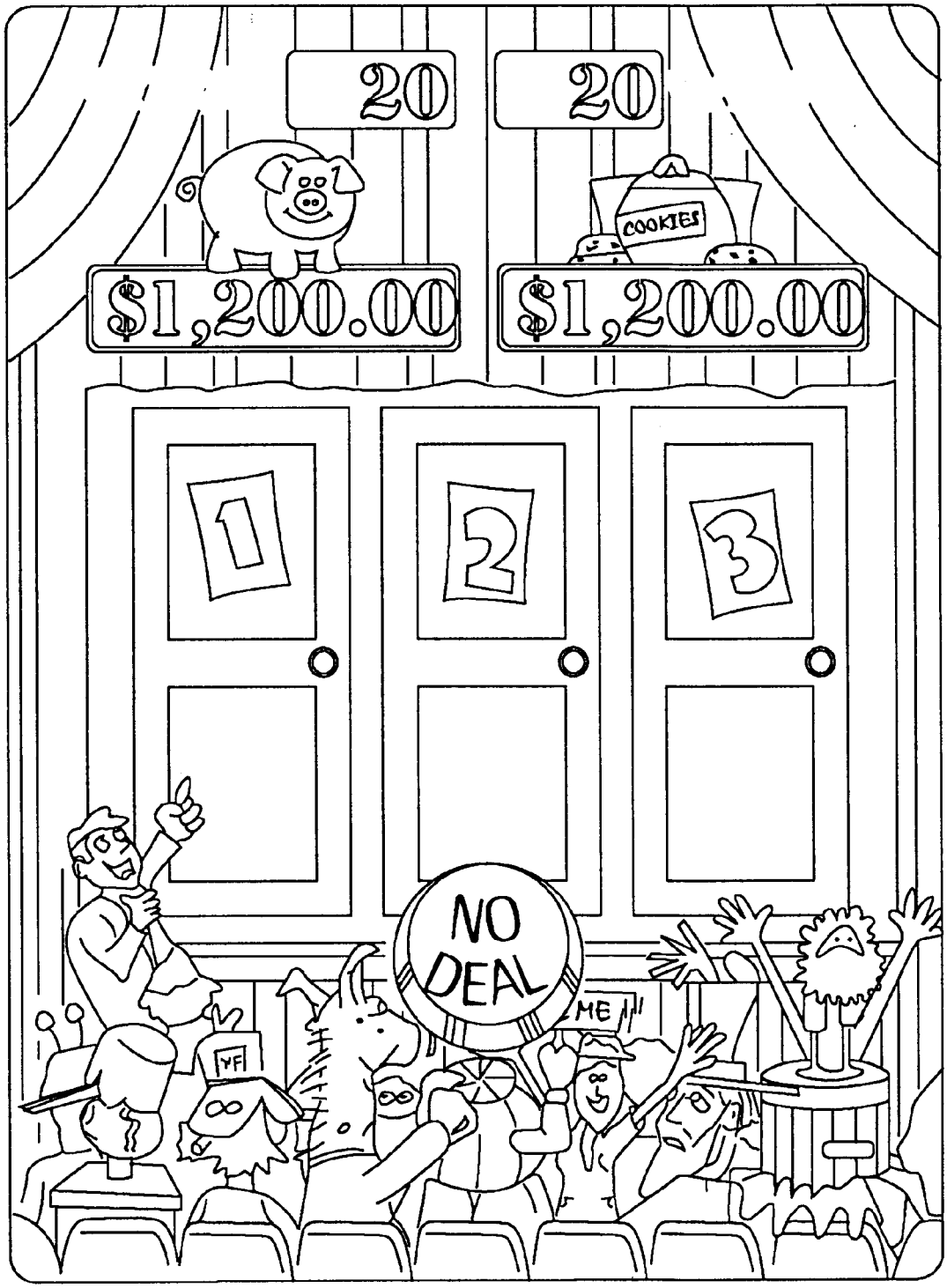
FIG. 7 shows an example of a second screen layout, visually different from the first screen layout of FIG. 6, which represents the appearance of a selection among at least three doors.

FIGS. 6 and 7 show a thematically continuous first segment (FIG. 6) and second segment (FIG. 7) which could be used in the practice of the present invention.

Workers skilled in the art will recognize that the above example is not intended to limit the scope of the invention, and that other examples exist which do not depart from the spirit and scope of the invention, and are encompassed by the appended claims.

What is claimed is:

1. A method of playing a video wagering game, the game comprising at least a first segment and a second segment, the method comprising the steps of:

placing a wager to participate in a first video wagering game having a first screen format;

playing the first segment of the video wagering game;

continuing play of the first segment until at least one predetermined condition has been met;

assigning a payout based on at least one predetermined winning outcome of the first segment;

playing the second segment of the video wagering game when the at least one predetermined condition has been met;

wherein at least a portion of said payout of the first segment is directly used as a wager in a second segment video wagering game in which a second screen format is used in the play of the second segment, which second screen format is visually different from the first screen format, and the second screen format is used in the play of a different wagering game than that played in said first segment; and after play of the second segment video wagering game, a second segment payout is assigned based on at least a predetermined outcome of play of the second segment video wagering game.

2. The method of claim 1 wherein the first segment comprises poker.

3. The method of claim 1 wherein the first segment comprises stud poker.

4. The method of claim 1 wherein the first segment comprises draw poker.

5. The method of claim 1 wherein the first segment comprises Let It Ride® poker.

6. The method of claim 1 wherein the first segment comprises Caribbean Stud® poker.

7. The method of claim 1 wherein the second segment comprises two card high low.

8. The method of claim 1 wherein the second segment comprises poker.

9. The method of claim 1 wherein the second segment is Let It Ride® poker, wherein the predetermined winning outcomes and corresponding factors are as follows:

| Hand | Multiplier |
|---|---|
| Royal flush | 100 |
| Straight flush | 50 |
| Four-of-a-kind | 25 |
| Full house | 6 |
| Flush | 5 |
| Straight | 4 |
| Three-of-a-kind | 3 |
| Two pairs | 2 |
| Medium pair | 1 |
| Low pair | 1 |
| Nothing | 1. |

10. The method of claim 1, wherein the first segment is Let It Ride® poker, wherein the set of predetermined winning outcomes and corresponding factors comprise:

| Winning Outcome | Payout |
|---|---|
| Royal flush | 1000 |
| Straight flush | 200 |
| Four-of-a-kind | 50 |
| Full House | 9 |
| Flush | 6 |
| Straight | 5 |
| Three-of-a-kind | 4 |
| Two pairs | 3 |
| Jacks or Better pair | 2 |
| Pair of 9's or 10's | 1. |

11. The method of claim 1 wherein a payout from at least one predetermined winning outcome from the second segment is augmented with a progressive jackpot.

12. The method of claim 11, wherein the progressive jackpot payout is 100 percent of the progressive jackpot when the player obtains a royal flush, and a maximum bet has been placed.

13. The method of claim 1 wherein said first segment comprises a video reel slot game.

14. The method of claim 13, wherein the video format of said second segment does not display a video reel slot game.

15. The method of claim 2 wherein the video format of said second segment does not automatically display a number of cards equal to the number of cards initially displayed in the play of said poker in said first segment.

16. The method of claim 1 wherein each said first segment and said second segment provide formats on a screen which do not include playing cards.

17. The method of claim 1 wherein only one video format of said first segment and said second segment displays playing cards.

18. The method of claim 1, wherein the apparatus includes a feature of providing a meter for keeping track of a number of winning outcomes which is independent of credits for play retained or awards from a single play of any segment.

19. A method of scoring a video wagering game, comprising the steps of:

a player placing a wager to participate in a video wagering game;

providing a video display cabinet, a device for accepting wagers mounted in the cabinet, a visual display mounted in the cabinet, a plurality of player controls mounted in the cabinet, a microprocessor located in the cabinet, RAM and ROM storage; wherein a program is stored in the ROM for playing a video wagering game with a first segment and a second segment, and a device for dispensing payouts; wherein the visual display, player controls and device for dispensing payouts is in electronic communication with the microprocessor;

the player activating a player control which causes the microprocessor to display the first segment of the game;

a player playing the first segment of the game, wherein the player controls are optionally manipulated by the player to participate in the game;

upon the happening of at least one predetermined condition, the microprocessor assigning a payout to the first segment and causing the second segment of the game to be displayed;

the player, upon electing to participate in the second segment of the game, places at least a portion of the award from play of the first segment, which second segment is a different game than the first segment of the game and which second segment is played in association with a visually different formatted screen than was associated with the play of the first segment; and wherein an award outcome of the second segment is determined by accomplishing a predetermined outcome in the second segment; and paying the player an amount based upon the award achieved by the outcome of the second segment.

20. The method of claim 19 wherein the award outcome of said second segment includes a non-monetary award which may be accumulated towards a special feature.

21. The method of claim 20 wherein said special feature comprises play of a segment for a chance to win ajackpot.

22. The method of claim 19 wherein the first segment of the game comprises Let It Ride® poker.

23. A video wagering device for play of a video wagering game having at least a first and second segment, comprising:

a cabinet;

a screen display mounted in the cabinet;

player controls mounted in the cabinet;

a device for receiving wagers mounted in the cabinet;

a payout device for paying player winnings mounted in the cabinet;

a microprocessor located within the cabinet RAM and ROM memory, where a program is stored in the ROM memory which comprises a video wagering game with at least a first segment and a second segment, wherein the program generates a first screen display corresponding to the first segment and a second screen display corresponding to the second segment, wherein player instructions received from the player controls are acted upon by the microprocessor, wherein an outcome from the first segment is used to allow a player an option of playing said second segment video wagering game, and a video format used in association with play of said second segment video wagering game is visually different from a video screen format used in association with play of said first segment video wagering game.

24. The device of claim 23 wherein the microprocessor is programmed to play video poker as the first segment, and blackjack as the second segment.

25. The method of claim 1, wherein the first segment is selected from the group consisting of: video poker, video reel slot, video blackjack, solitaire, bingo, tick tack toe, hangman and video keno.

26. The method of claim 1, wherein the second segment is selected from the group consisting of: video poker, video reel slot, video blackjack, solitaire, a door game, bingo, tick tack toe, hangman and video keno, play of which second segment is associated with a visually different screen format as compared to a video screen format used with said first segment.

27. The method of claim 1 wherein video displays of said first segment and said second segment are thematically continuous.

28. The method of claim 23 wherein a video display format used in association with play of said second segment video wagering game is thematically continuous with respect to a video display of said first segment.

29. A method of scoring a video wagering game, the game comprising at least a first and second segment, the method comprising the steps of:

placing a wager to participate in a video wagering game;

playing the first segment of the video wagering game;

continuing play of the first segment until at least one award-achieving condition has been met;

assigning a payout based on said at least one award-achieving condition of the first segment;

playing the second segment of the video wagering game when the at least one award-achieving condition has been met;

wherein at least a portion of said payout of the first segment is directly carried into said second segment as a wager in a second segment video wagering game in which a visually different screen format is used in play of a different game in the play of the second segment; and after play of the second segment video wagering game, a second segment payout is assigned based on at least a predetermined outcome of play of the second segment video wagering game.

30. The method of claim 29 wherein a portion of said payout based on said at least one award-achieving condition of the first segment must be carried forward as a wager in said second segment.

31. The method of claim 30 wherein a portion of said payout based on said at least one award-achieving condition of the first segment is retained as a credit or paid out to a player.

32. The method of claim 1 wherein said at least a portion of said payout of the first segment which is directly used as a wager in a second segment video wagering game is placed at least in part at risk of being diminished by play in said second segment.

33. The method of claim 2 wherein said at least a portion of said payout of the first segment which is directly used as a wager in a second segment video wagering game is placed at least in part at risk of being diminished by play in said second segment.

34. A method of playing a video wagering game, the game comprising at least a first segment and a second segment, the method comprising the steps of:

placing a wager to participate in a first video wagering game having a first screen format including a game show theme;

playing the first segment of the video wagering game;

continuing play of the first segment until at least one predetermined condition has been met;

assigning a payout based on at least one predetermined winning outcome of the first segment;

playing the second segment of the video wagering game when the at least one predetermined condition has been met;

wherein at least a portion of said payout of the first segment is directly used as a wager in a second segment video wagering game in which a second screen format is used in the play of the second segment, which second screen format is visually different from the first screen format and also represents a segment of a game show, and the second screen format is used in the play of a different wagering game than that played in said first segment; and after play of the second segment video wagering game, a second segment payout is assigned based on at least a predetermined outcome of play of the second segment video wagering game.

35. The method of claim 34 wherein said first video wagering game having a first screen format representing a game show, represents Let's Make a Deal®.

36. The method of claim 34 wherein said first video wagering game having a first screen format representing a game show, represents a different theatrical segment of Let's Make a Deal® than that represented in said first segment.

37. The method of claim 34 wherein said first segment and said second segment display thematic continuity.

38. The method of claim 34 wherein at least a portion of said payout based on at least one predetermined winning outcome of the first segment must be wagered in the play of said second segment and said second segment must be played.

39. The method of claim 3 wherein at least a portion of said payout based on at least one predetermined winning outcome of the first segment is placed at risk in said second segment.

40. A method of playing a video wagering game, the game comprising at least a first segment and a second segment, the method comprising the steps of:

placing a wager to participate in a first video wagering game having a first screen format;

playing the first segment of the video wagering game;

continuing play of the first segment until at least one predetermined condition has been met;

assigning a payout based on at least one predetermined winning outcome of the first segment;

playing the second segment of the video wagering game when the at least one predetermined condition has been met;

wherein at least a portion of said payout of the first segment is used as a wager in a second segment video wagering game in which a second screen format is used in the play of the second segment, which second screen format is visually different from the first screen format, and the second screen format is used in the play of a different wagering game than that played in said first segment; and after play of the second segment video wagering game, a second segment payout is assigned based on at least a predetermined outcome of play of the second segment video wagering game.

41. The method of claim 1 wherein the second segment payout is equal to a product of a randomly selected multiplier and an amount comprising the wager to participate in a first video wagering game.

42. The method of claim 1 wherein a meter displays an amount of the payout based on at least one predetermined winning outcome of the first segment.

* * * * *

UNITED STATES PATENT AND TRADEMARK OFFICE

CERTIFICATE OF CORRECTION

PATENT NO. : 6,312,334 B1
DATED : November 6, 2001
INVENTOR(S) : Mark L. Yoseloff It is certified that error appears in the above-identified patent and that said Letters Patent is hereby corrected as shown below:

Title page,
Item [73], Assignee area (missing), please insert: -- Shuffle Master, Inc., Eden Prairie, Minnesota --

Signed and Sealed this

Twelfth Day of November, 2002

*Attest:*

*Attesting Officer*

JAMES E. ROGAN
*Director of the United States Patent and Trademark Office*